US012390704B2

(12) United States Patent
Caya

(10) Patent No.: US 12,390,704 B2
(45) Date of Patent: Aug. 19, 2025

(54) GOLF TEE AND GOLF TEE KIT

(71) Applicant: Mario Caya, Perth (CA)

(72) Inventor: Mario Caya, Perth (CA)

( * ) Notice: Subject to any disclaimer, the term of this patent is extended or adjusted under 35 U.S.C. 154(b) by 0 days.

(21) Appl. No.: 18/087,917

(22) Filed: Dec. 23, 2022

(65) Prior Publication Data

US 2023/0201683 A1 Jun. 29, 2023

Related U.S. Application Data

(60) Provisional application No. 63/293,521, filed on Dec. 23, 2021.

(51) Int. Cl.
*A63B 57/10* (2015.01)

(52) U.S. Cl.
CPC ..... *A63B 57/10* (2015.10)

(58) Field of Classification Search
CPC ..... A63B 57/10
See application file for complete search history.

(56) References Cited

U.S. PATENT DOCUMENTS 1,636,655 A * 7/1927 Young ..... A63B 57/10 D21/717
2,612,373 A * 9/1952 Maurice ..... A63B 57/0032 473/388
2,626,806 A * 1/1953 Carlton ..... A63B 67/193 473/579
2,761,685 A * 9/1956 Charles ..... A63B 67/193 273/DIG. 6
3,690,676 A * 9/1972 Frank ..... A63B 57/10 473/398
3,697,082 A * 10/1972 Di Laura ..... A63B 57/10 473/387
3,891,215 A * 6/1975 Maconachie ..... A63B 67/187 473/579
4,509,761 A * 4/1985 Liu ..... A63B 67/187 473/579
5,033,747 A * 7/1991 Young ..... A63B 57/12 D21/717

(Continued)

FOREIGN PATENT DOCUMENTS

CN 206867634 U * 1/2018
CN 108379803 A * 8/2018 ..... A63B 67/187

(Continued)

*Primary Examiner* — Steven B Wong
(74) *Attorney, Agent, or Firm* — Andrews Robichaud PC; Alessandro Colonnier

(57) ABSTRACT

A golf tee is provided comprising a neck for supporting a golf ball and a reinforced skirt connected to the neck for providing elasticity to the golf tee. The golf tee has an open body connected to the reinforced skirt, the open body having a support rim for supporting the golf tee and an upper end for supporting the neck. The open body comprises a plurality of support columns, each support column having an upper end and a lower end and at least one support ring transversely connecting each support column of the plurality of support columns to at least another of the support columns within the open body, wherein the open body defines a plurality of holes thereby reducing the weight of the golf tee, and the plurality of support columns and the at least one support ring increase the surface area of the golf tee thereby increasing drag on the golf tee.

20 Claims, 8 Drawing Sheets

(56) References Cited

U.S. PATENT DOCUMENTS

| | | | | | |
|---|---|---|---|---|---|
| 5,421,587 | A * | 6/1995 | Mao-Huang | A63B 67/187 | 473/579 |
| 6,110,059 | A * | 8/2000 | Haggarty | A63B 57/10 | 473/387 |
| 6,200,233 | B1 * | 3/2001 | Moody | A63B 57/10 | 473/387 |
| D461,216 | S * | 8/2002 | Luther, Sr. | D21/717 | |
| 7,901,303 | B2 * | 3/2011 | Toyosawa | A63B 57/10 | 473/390 |
| 7,951,018 | B2 * | 5/2011 | Caya | A63B 57/15 | 473/390 |

FOREIGN PATENT DOCUMENTS

| | | | | | |
|---|---|---|---|---|---|
| CN | 209984895 | U * | 1/2020 | | |
| CN | 215310115 | U * | 12/2021 | | |
| EP | 0017487 | A2 * | 10/1980 | | |
| GB | 2263412 | A * | 7/1993 | A63B 67/187 | |
| GB | 2441979 | A * | 3/2008 | A63B 67/187 | |
| KR | 20070121416 | A * | 12/2007 | | |
| WO | WO-2016005546 | A1 * | 1/2016 | A63B 67/18 | |
| WO | WO-2018194011 | A1 * | 10/2018 | A63B 67/193 | |
| WO | WO-2019132649 | A1 * | 7/2019 | A63B 67/187 | |
| WO | WO-2019141176 | A1 * | 7/2019 | | |

* cited by examiner

GOLF TEE AND GOLF TEE KIT

FIELD

The present invention relates to golf equipment and more specifically to a golf tee for teeing a golf ball.

BACKGROUND

The world of golf is always in constant motion and there is always a need for new and improvement golf equipment. Specifically, there is a need for an improved golf tee.

In the game of golf, a golf tee is commonly used to tee a golf ball for the first shot of a hole. Typically, the golf tee supports the golf ball and elevates the golf ball above the ground to thereby provide an improved lie for better contact between the golf club that the golfer is using and the golf ball.

It is desirable to be able to tee the golf ball to various heights depending on the type of golf club being used, the distance that the golfer is attempting to hit the golf ball, the lie, the style of golf swing, etc. Typically this has been done by providing a wooden golf tee having a shaft suitable for penetrating the ground and a cup suitable for supporting the golf ball. The golf tee is sunk into the ground the desired amount and the ball is placed on the golf tee. A problem with this type of tee is pushing the tee precisely into the ground the exact same desired distance in order to replicate a consistent elevation every time and for each golf club a golfer may use. Another problem with this type of golf tee is that it can easily be broken during impact by the golf club as it is stuck into the ground. Additionally, this type of golf tee provides little aerodynamic resistance and can therefore travel through the air a long distance as a result of being struck by the golf club. As such, typical golf tees are easily lost or broken and a golfer will often have to replace the tee many times during a round of golf. This also contributes to the pollution over time of the golf course.

One attempt at overcoming this problem is provided by a golf tee which sits on top of the ground as opposed to being sunk into the ground. This reduces the risk of breakage at impact as the golf tee is simply propelled when impacted by the golf club. However, this type of golf tee is propelled a long distance and can be lost. Additionally, adjustment of the height of the golf ball is not possible. One type of tee adapted to sit on top of the ground is a brush tee where the ball is supported by a plurality of bristles. However, the bristles are gradually bent during repeated use making it impossible to properly support a golf ball without replacing the brush tee.

U.S. Pat. No. 7,951,018 (Caya) discloses a golf tee which addresses some of the concerns raised above, however, the golf tees described in Caya have the drawback of breaking at the top end of the tee. Such breakage reduces the product lifespan and the material used in Caya is also a more brittle product having much less elasticity.

Accordingly, there is a need for a golf tee which will not break near the top end of the end, with increased elasticity and having a longer lifespan than disclosed in Caya.

SUMMARY

In a first aspect, the present disclosure provides a golf tee comprising a neck for supporting a golf ball; a reinforced skirt connected to the neck for providing elasticity to the golf tee; and, an open body connected to the reinforced skirt, the open body having a support rim for supporting the golf tee and an upper end for supporting the neck.

In another aspect, the present disclosure provides a golf tee kit comprising at least two golf tees each having a different height, each one of the at least two golf tees comprising: a neck for supporting a golf ball; a reinforced skirt connected to the neck for providing elasticity to the at least two golf tees; and, an open body connected to the reinforced skirt, the open body having a support rim for supporting the at least two golf tees and an upper end for supporting the neck.

BRIEF DESCRIPTION OF THE DRAWINGS

The embodiments of the present invention will now be described by reference to the following figures, in which identical reference numerals in different figures indicate identical elements and in which.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION OF THE INVENTION

The term "connected", along with their derivatives, may be used herein. It should be understood that these terms are not intended as synonyms for each other. Rather, in particular embodiments, "connected" may be used to indicate that two or more elements are in direct physical. "Coupled" may be used to indicated that two or more elements are in either direct or indirect (with other intervening elements between them) physical or electrical contact with each other, or that the two or more elements co-operate or interact with each other (e.g. as in a cause and effect relationship).

Figure 1:
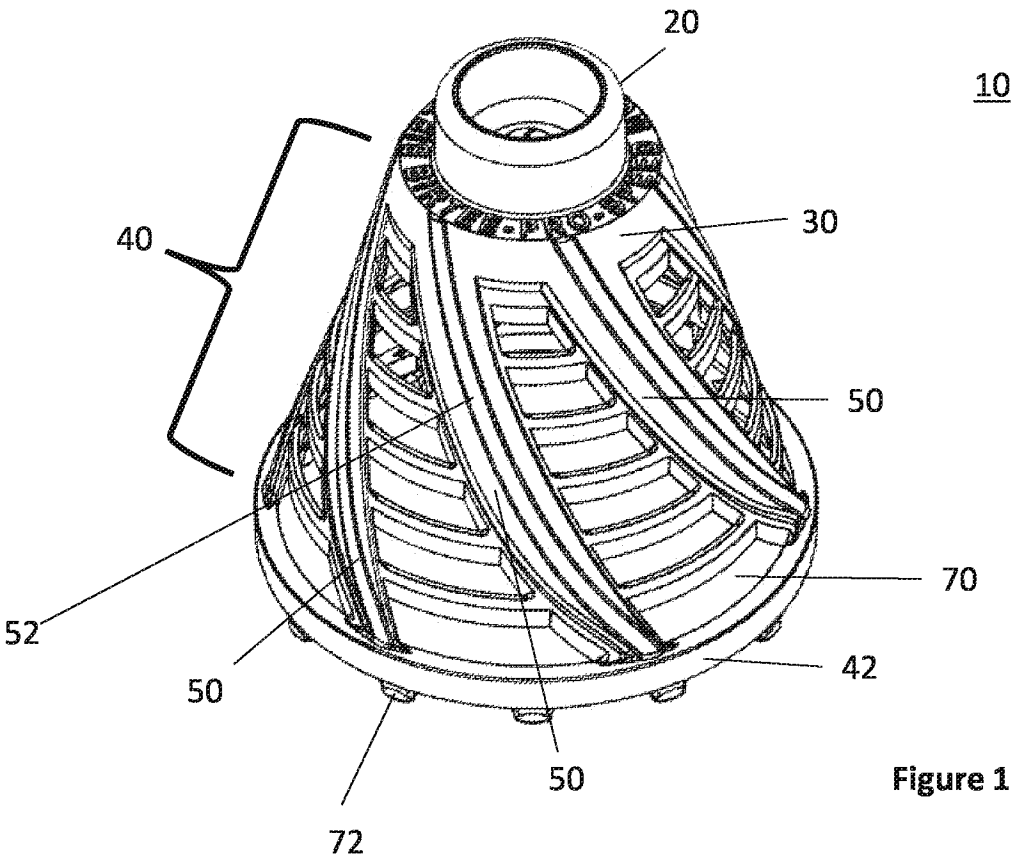
FIG. 1 is a perspective view of a golf tee according to one embodiment of the present invention.
Figure 2:
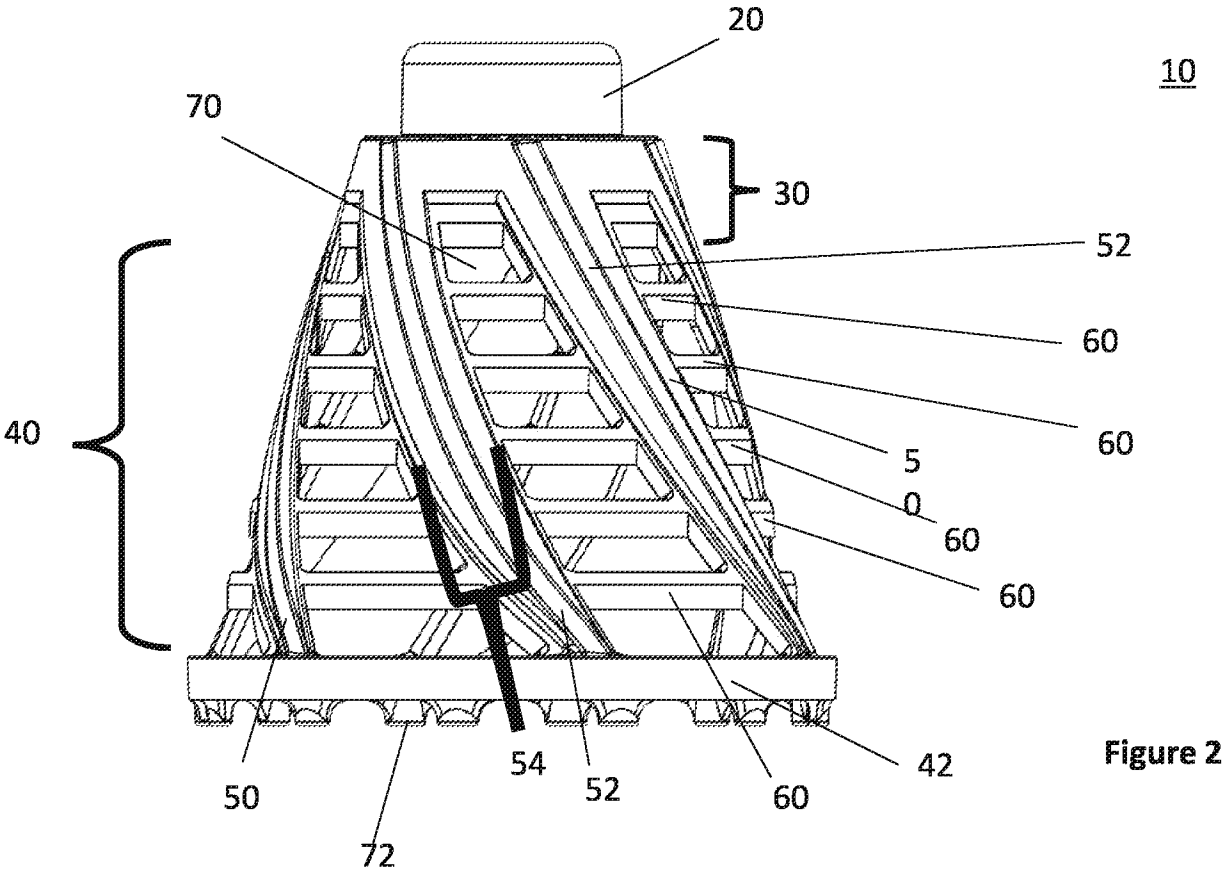
FIG. 2 is a side view of a golf tee according to one embodiment of the present invention.
Figure 3:
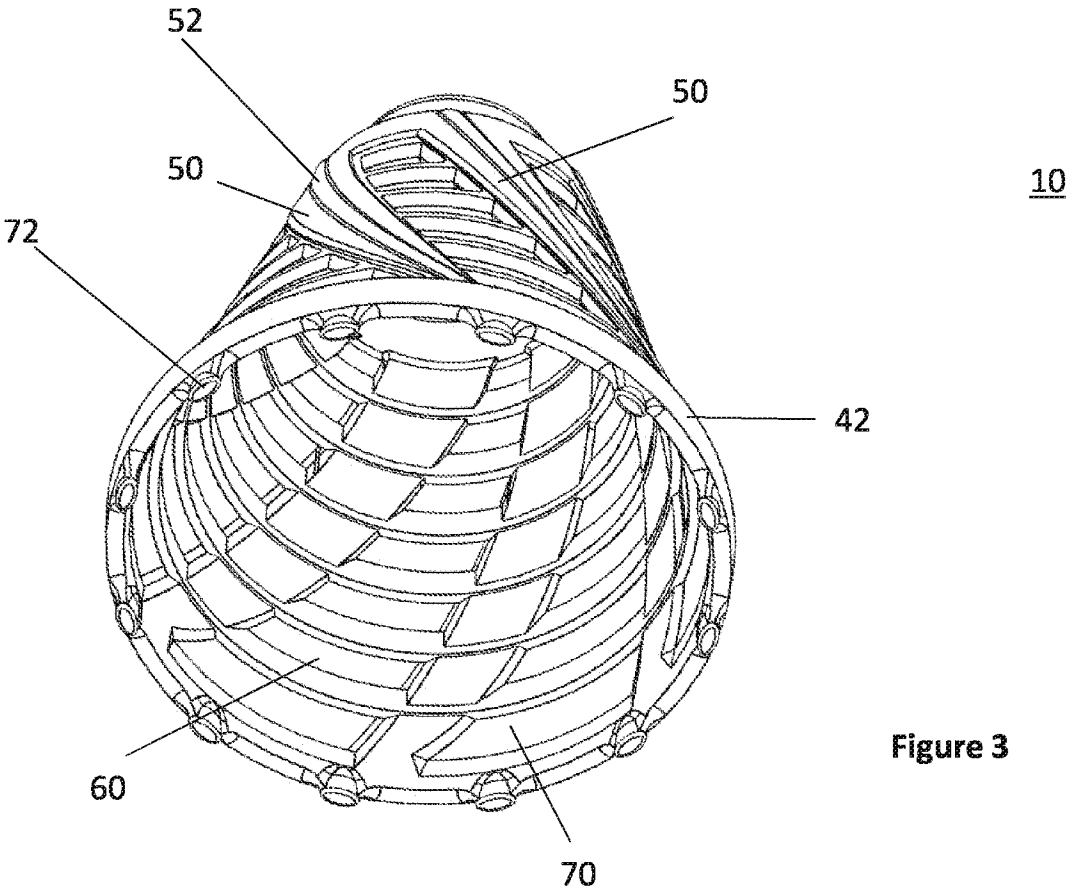
FIG. 3 is an underside view of a golf tee having an open body according to one embodiment of the present invention.

With reference to FIGS. 1-3 and according to one embodiment of the present invention, a golf tee 10 is shown. Golf tee 10 has a neck 20 for supporting a golf ball (not shown). Neck 20 may also include a lip providing a larger surface for supporting a golf ball. Golf tee 10 also has a reinforced skirt 30 connected to neck 20 which provides for greater elasticity of golf tee 10. The improved elasticity provides a longer life span of golf tee 10 since without the reinforced skirt the neck 20 can snap off from golf tee 10 after numerous uses of the golf tee 10 by a golfer.

With further reference to FIGS. 1-3 and according to one embodiment of the present invention, golf tee 10 has an open body 40 (as clearly shown in FIG. 3) connected to reinforced skirt 30 which provides support to golf tee 10. Open body 40 has a support rim 42 for supporting golf tee 10. Support columns 50 are also present in open body 40 with each column having an upper end and a lower end connecting the reinforced skirt 30 with the support rim 42. The support columns 50 also have a reinforced rib 52 rendering the tee more solid. Support columns 50 also have a width 54 which provides further rigidity to the tee. The presence of rib 52 is not essential as support column without rib 52 would still allow the tee of the present invention to function. Width 54 is larger than the width of support rim 42 for example. The larger width 54 is also beneficial in the manufacturing process as it allows the retrieval of the tees from the mold without the tees sticking in the mold and possibly breaking. Support rim 42 also has protrusions for increased friction and stability.

With further reference to FIG. 2 and according to one embodiment of the present invention, golf tee 10 has support rings 60 connecting each support columns 50 within open body 40. In the present embodiment, golf tee 10 has a number of support rings 60 and more specifically 5 support rings 60 within the body. The total number of support rings 60 can be varied but requires at least one for the present invention. The presence of more than one support ring 60 also increases the surface area of the open body 40 thereby increasing the drag force when the golf tee 10 is struck by a golf club. The number of support rings will also vary depending on the height of the tee as will be further described in the kit below. For example, the shorter the tee then the less support rings will be present. The support rim 42 is wider and thicker than support rings 60 in order to provide more rigidity to the tee. The presence of the support rim 42 and support rings 60 allows for the tee of the present invention to have a longer lifespan since if either is ruptured then the other remaining rim or ring can still maintain the tee's overall structure for continued use.

With further reference to FIGS. 1-3 and according to one embodiment of the present invention, golf tee 10 has a plurality of holes 70 which reduces the weight of golf tee 10. The number of holes 70 within a golf tee 10 can vary based on a draft factor desired for the golf tee. The presence of holes also reduces the amount of travel a tee may travel after being it by a golf club.

Figure 4:
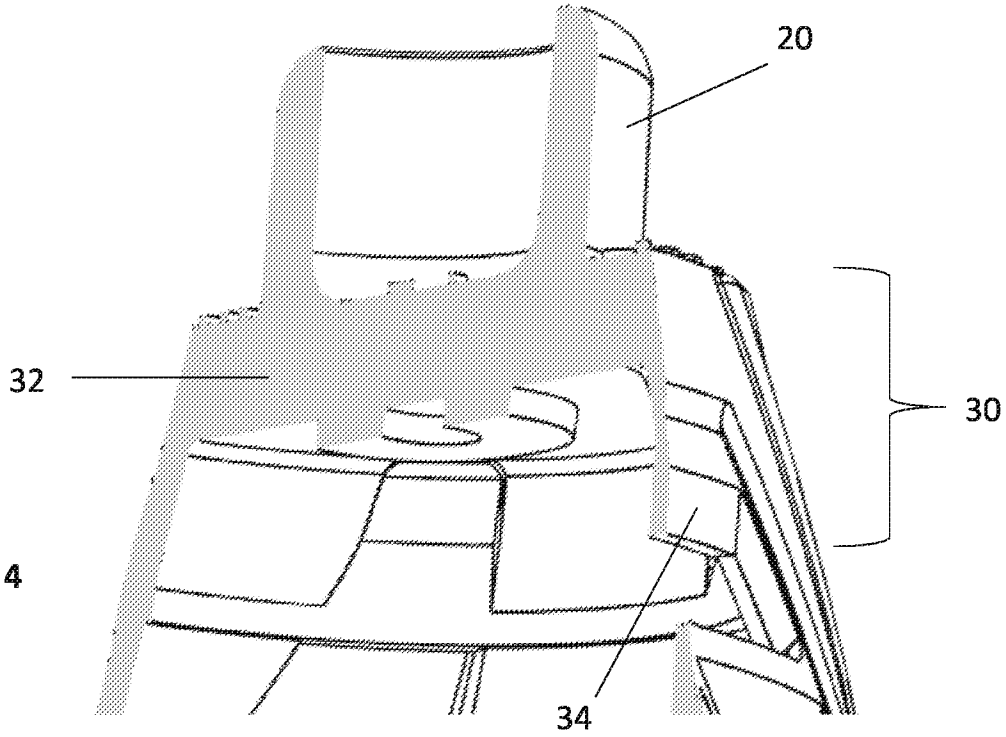
FIG. 4 is a cut-away view of the neck and the reinforced skirt of a golf tee according to one embodiment of the present invention.

With reference to FIG. 4 and according to one embodiment of the present invention, a cut away view of the neck 20 and reinforced skirt 30 of a golf tee is shown. Reinforced skirt area 30 has a crown area 32 providing increased elasticity between open body 40 and neck 20. Reinforced skirt area 30 also has connected to crown area 32 a skirt ring 34 which skirt ring 34 also interconnects support columns 50 at the upper end of support columns 50. The presence of crown area 32 and skirt ring 34 increases the elasticity and the golf tee's lifespan as it reduces the chances of neck 20 breaking off from the golf tee.

The present invention in one embodiment is made from a very flexible polyethylene having a very low density namely a VLDPE. The use of such a material provides better physical properties than the previous material: it has higher: Tensile Strength, Tensile Elongation, Impact, and can take colder temperatures for brittleness. The present invention can also be fabricated from Dynaflex (a form of a thermoplastic elastomer) which provides a greater degree of flexibility allowing for the tee to be flipped inside out and returned to its original shape if desired. This feature can be appreciated by golfers that like to put their tees in their pockets. This material allows the tees to be squished and then regain their original shape once the golfer has taken the tee out of his or her pocket. This material will also be effective against extreme temperatures without becoming brittle and can be ideal for winter golf.

Figure 8:
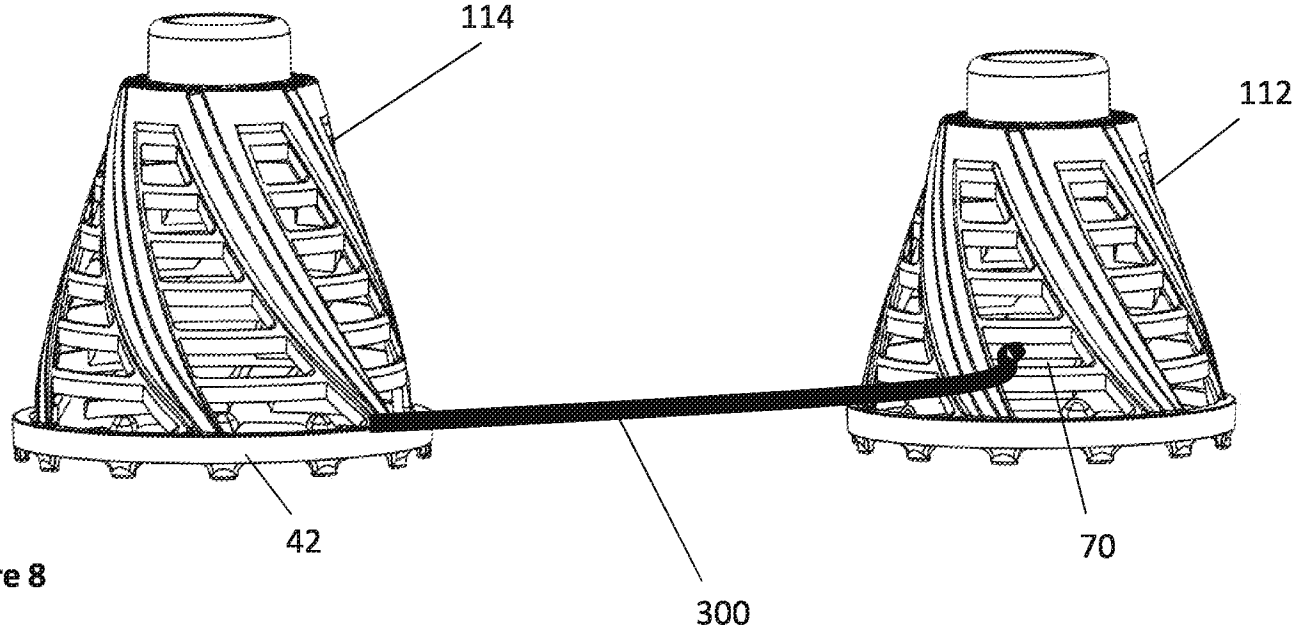
FIG. 8 is a side view of two tees linked to one another through the use of a linking member according to one embodiment of the present invention.

With reference to FIG. 8 and according to another embodiment of the present invention, two tees 114 and 112 can be tied together for ease of use. The linking of tees can be beneficial for a number of reasons among others such as to prevent the tees from flying too far as a safety precaution when practicing at a driving range. It can also avoid losing the tees if hitting balls from a tee box which is near a cliff or a pond for example. Specifically, the two tees 112 and 114 are tied or linked to one another through the use of a rope 300 or a linking member 300. Rope 300 can be secured to a tee through either one of the support rings or holes within the tee. By linking two or more tees to one another this allows for an easier retrieval of the tees from the ground. For example, two tees linked together with a rope 300 can be picked up with a golf club which can be easier with a golfer who has physical ailments or issues. The length of the rope or link is only limited by the available length of the rope or link. The action of linking two tees or more is not limited to a rope but can also include a chain or any flexible material which can be in the shape of a rope. It should also be noted that more than two tees could be tied together such as 3, 4 or even 5 tees as preferred by an individual.

In another embodiment of the present invention, an anchor could be used in association with a linking member wherein one end of the linking member is connected to the anchor and the opposite end of the linking member is connected to a tee. An anchor could have multiple linking members having one end connected to the anchor with multiple tees connected to the opposite ends of the linking member.

In another embodiment of the present invention, blind individuals may also use the kit of tees. For example, a BLIND golfer can tell the height of the tees by feeling the number on the inside of the tees and the MATH/GOLF formula to determine the HEIGHT of the tees is the TEE #divided by four such as follows:

Tee #1 is ¼"
Tee #2 is ½"
Tee #3 is ¾"
Tee #4 is 1"
Tee #5 is 1¼"
Tee #6 is 1½"
Tee #7 is 1¾" &
Tee #8 is 2 inches.

This embodiment requires the presence of numbers within the open body of the set of tees or within the hollow portion of the neck for example.

A golfer can also determine the Height of the tees visually or by feel without looking or feeling the number inside the tee. Tees #1 and #2 are easy to determine the size by feel or by simply looking at them. For tees 104 to 114 it can be more difficult. Accordingly, the height of these tees can be determined as follows:

For tees #3 to #8: ADD 2 to the number of Horizontal RINGS or HOLES. For example, as follows:

Tee #5 has 3 Horizontal Rings or 3 levels of Holes.
So 3+2=Tee 105 and Tee #5 is 1¼" high.
Or Tee #7 has 5 Horizontal Rings or 5 levels of Holes.

So 5+2=Tee #7 and Tee #7 is 1¾" high.

In use, the golf tee 10 is placed on the ground and a golf ball is placed on the neck 20. By having an open body 40, any grass that the tee 10 is placed on may simply nestle within the body 40 and even extend through the holes 70. This allows for a substantially level placement of the tee 10 on the ground even in the event of thick and/or longer grass. Another advantage of the present invention is the tees when used in golf simulators (or in any other use) will be propelled forward and will not propel backwards possibly injuring a person in close proximity.

It will be appreciated that the tee 10 may also be used on any hard surfaces, such as a gymnasium floor, golf simulators, artificial turf, garage, boat deck, ice, snow, etc., or a soft surface such as sand. A conventional tee is not suitable or usable for most of these surfaces. This allows a golfer to practice in a much broader range of locales and allows a golfer to play and practice with the same tee 10 or the same style of tee having varying heights.

Additionally, because the tee 10 has a high drag and a low weight to drag ratio as a result of the general lay-out of the body 40 of the tee 10, the tee 10 acts as a high drag projectile when struck by a swung golf club. This means that the tee 10 will tend to travel a shorter distance relative to prior golf tees when struck by a swinging golf club. This feature facilitates the finding of the golf tec. It results in fewer lost tees and therefore a lower replacement frequency. It may also speed up the round of golf as less time is spent finding a struck golf tee.

Tests have also shown that teeing up using the tee 10 can be up to three times faster than using a wooden tee or a zero-friction tee or a brush tee. Less energy may be used to set up a tee 10 as it is not necessary to push the tee 10 into the ground. The ground can at times be harder and require more energy for a traditional tee to be pushed into the ground. This reduces the risk of injury to the golfer and removes the risk of breaking tees during setup or swinging of the golf club due to the hardness of the ground. This can be beneficial to golfers suffering from back problems, tendonitis, carpel tunnel syndrome, tennis elbow, or arthritic pain and discomfort. This can also be beneficial to very young beginner golfers or weaker older golfers. Tests have shown that a 4 year old can easily and quickly set up his own ball without any assistance.

A tee 10 as outlined above also ensures a consistent teeing up height each time the tee 10 is used thereby allowing for consistency of impact and therefore a possible improvement in golf score. To further enhance the drag to weight ratio, the golf tee 10 may be made of light weight material, such as: nylon, mesh, cloth, any suitable plastic, etc.

In order to vary the height of the tee 10 so that a number of tee heights may be provided for a golfer, the tee 10 may be made with different heights. This can be accomplished for example by varying the height of either or both the optional neck 20 and the body 40.

Figure 5:
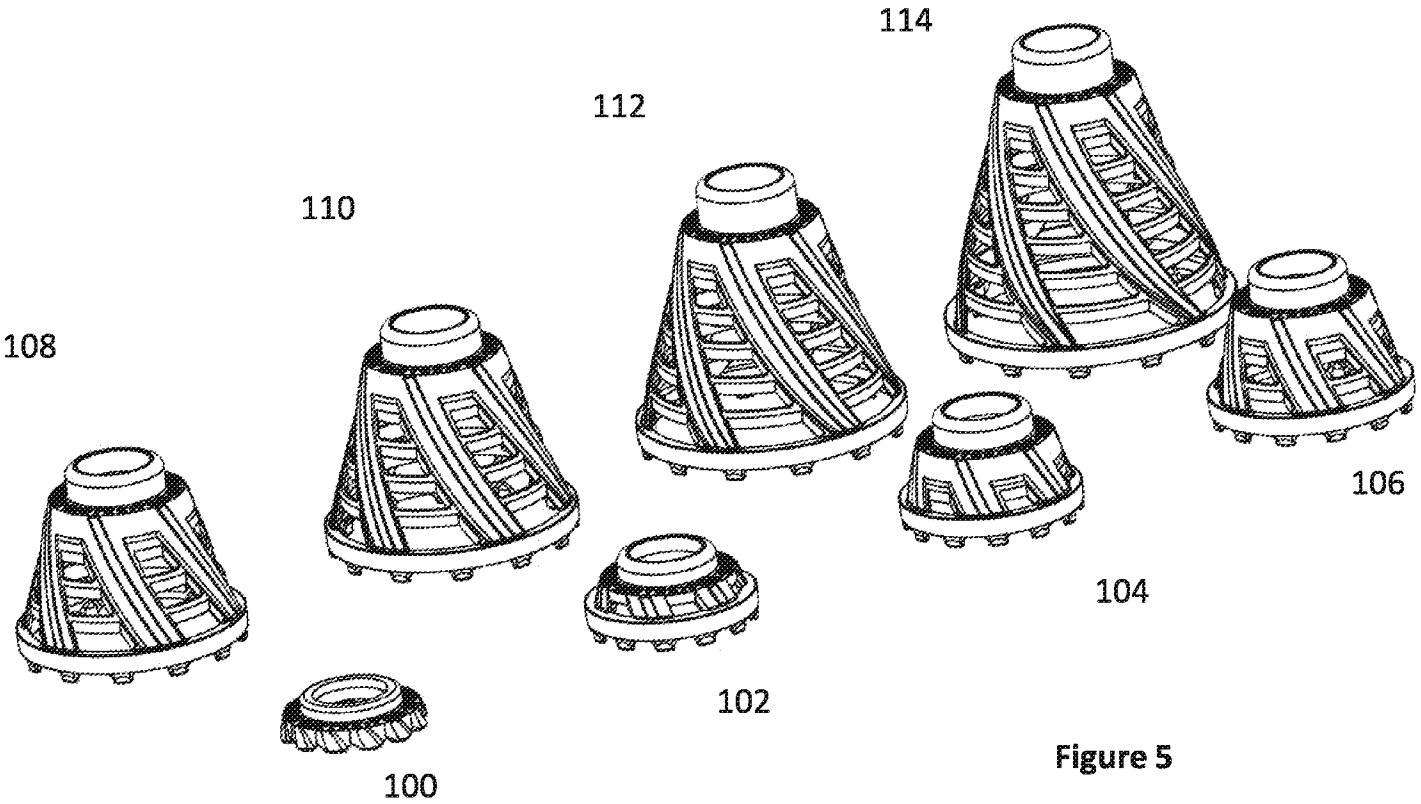
FIG. 5 is a perspective view of a set of tees according to one embodiment of the present invention.

With reference to FIG. 5 and according to one embodiment of the present invention, an example of a set of tees 100, 102, 104, 106 108, 110, 112, 114, and 116, each having a different overall height. Each tee 100, 102, 104, 106 108, 110, 112, 114, and 116 has a different height so that a golfer has an option in selecting a desired teeing up height. It will be appreciated that because each tee has a conical open body, the tees 100, 102, 104, 106 108, 110, 112, 114, and 116 of the set are stackable which facilitates packaging and packing in a golf bag. As shown in FIG. 5, the tees may comprise webbing or mesh to increase the surface area of the tee and thereby increase the amount of drag when the tee is struck. It will be appreciated that mesh may extend up to the neck. Further, even shorter tees such as 100, 102, 104, 106 and 108 may comprise some mesh to increase drag or may also have no mesh.

Different shapes—the open body of a golf tee according to another embodiment of the present invention may have an open pyramidal shape. This embodiment illustrates that the tee is not restricted to a conical shape but may have any suitable open shape such as, a triangular pyramid, square pyramid, pentagonal pyramid or any other polyhedron. Each tee has a different height so that a golfer has an option in selecting a desired teeing up height.

Figure 6:
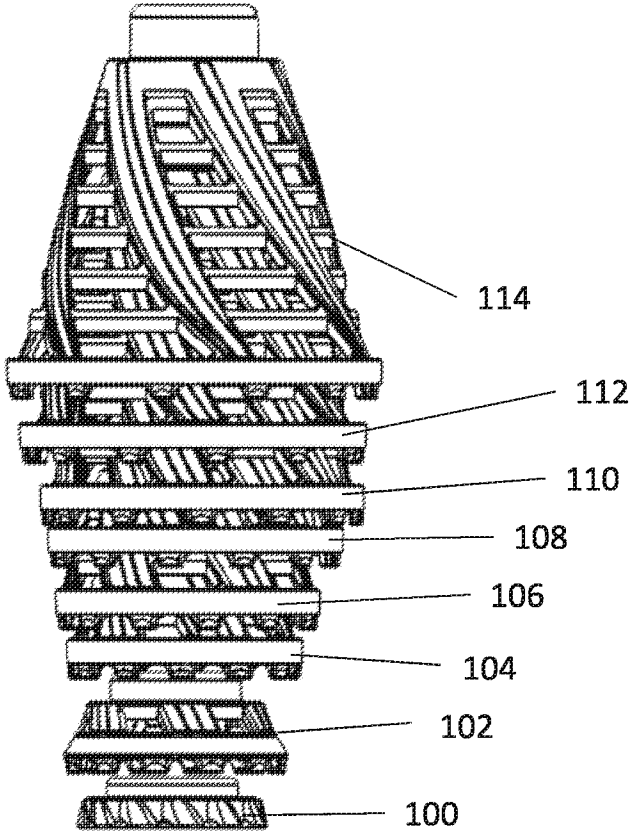
FIG. 6 is a side view of the set of tees from FIG. 5 in a suspended stack according to one embodiment of the present invention.
Figure 7:
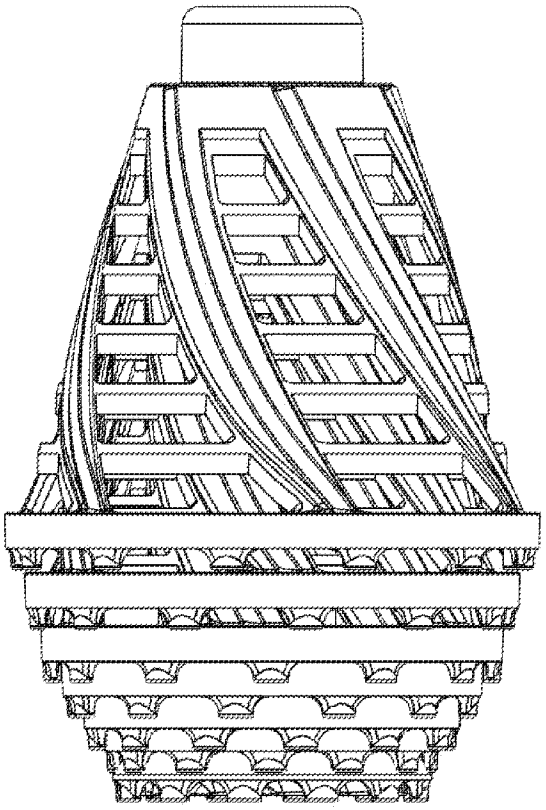
FIG. 7 is a side view of a set of tees stacked forming a kit according to one embodiment of the present invention.

With reference to FIGS. 6 and 7 and according to one embodiment of the present invention, it will be appreciated that because each tee has an open body, the tees of the set are stackable which facilitates packaging and packing in a golf bag as shown. The ability to stack two or more tees of the present invention provides a kit 200 of golf tees.

With further reference to FIG. 5 and according to one embodiment of the present invention, the golf tees 100, 102, 104, 106 108, 110, 112, 114, and 116 may have varying heights thereby allowing for a golfer to select a tee of a desired height to support the golf ball. In order to more easily identify the heights of each tee, for example, the tee may include an indicia (not shown) indicating the height. Such indicia may be in the form of a colour, a number, a height measurement, etc. A single tee may include more than one indicia, for example both a coloured support rim and a number.

With further reference to FIGS. 1, 2, 3 and 4 and according to an embodiment of the present invention, the golf tee 10 comprises a neck 20 for supporting a golf ball; a reinforced skirt 30 connected to the neck 20 for providing elasticity to the golf tee; and, an open body 40 connected to the reinforced skirt 30, the open body 40 having a support rim 42 for supporting the golf tee 10 and an upper end for supporting the neck 20. The open body 40 is further comprised of a plurality of support columns 50, each support column 50 extending from the support rim 42 to the reinforced skirt 30. The open body 40 is also comprised of at least one support ring 60 transversely connecting each support column 50 to an adjacent support column 50. As shown, the open body 40 defines a plurality of holes 70 thereby reducing the weight of the golf tee. The plurality of support columns 50 and support rings 60 increase the surface area of the golf tee 10, thereby increasing drag on the golf tee 10. The support columns 50 curve along the open body 40, from a first position on the support rim 42 to a second position on the reinforced skirt 30, the second position offset from the first position along a radius of the golf tee. Indeed, a worker skilled in the art would appreciate that the golf tee 10 has a radius, and that it is desirable to curve the support columns 50 down the open body 40 to different positions along the radius to increase the strength of the golf tee 10. The support columns 50 are further comprised of a reinforced rib 52 extending along the length of the support columns 50 to increase the rigidity of the golf tee 10. The support rim 42 is further comprised of protrusions 72 extending downwardly from the support rim 42 to increase the friction and stability of the golf tee 10. The support columns 50 have a first width, the first width being greater than a second width of the support rim 42. The reinforced skirt 30 is further comprised of a crown area 32 to provide increased elasticity between the open body 40 and the neck 20. The reinforced skirt 30 is also comprised of at least one skirt ring 34 to interconnect the plurality of support columns 40 to one another at an upper end of the plurality of support columns 40. The crown area 32 and at least one skirt 34 increase an elasticity and lifespan of the golf tee 10, and it is desirable for the crown area 32 to have a large depth, and a substantially larger depth than the width of the skirt ring 34, as shown in FIG. 4. The crown area 32 extends downwardly from the neck 20 of the golf tee 10 and is generally disc-shaped along the circumference of the golf tee 10. The skirt ring 34 extends downwardly from the crown area 32, within the plurality of holes 70 and in between adjacent support columns 40.

It has been found that a golf tee 10 as described above is very robust and may be used a plurality of times and over many rounds of golf without requiring replacement. Furthermore, as a golf tee having a higher height becomes worn through extensive use, it has been observed that the part of the tee which tends to wear more quickly is the lower end. Because it is the lower end which tends to wear first, the worn lower end may be trimmed off resulting in a usable tee having a reduced height. This allows for continued use of the tee as a tee with a lower height in a set of golf tees. The continued use of the reduced height tee also helps the reduction of pollution caused by broken tees on the golf course.

Another advantage of the present tees is the fact that the tees are recyclable which in turn reduces the impact on landfills. The tees are also recyclable from another perspective as by trimming them they become reusable for a longer period of time.

Another advantage is also the use of such tees is beneficial for groundskeepers since if the tees are left or forgotten on the fairway their presence will not damage the equipment used by the grounds crew namely lawnmowers or other machines or tools unlike tees that are made of much harder plastic, as this material is soft and flexible and easy to cut with scissors or a lawnmower blade.

Golf tees as disclosed above may range for example in heights starting from 0.25 inches and increasing by, for example consistent increments, of 0.25 inches. Although there is no maximum height limit, the tallest tee may be equal to or shorter than the standard permitted by the professional rules of golf.

The tee as disclosed above may also or alternatively be marked to indicate an appropriate golf club for use with a particular tee of a particular height.

In one embodiment, the golf tee may be formed from one piece of light weight material such as nylon, mesh, cloth, or any suitable plastic.

The golf tees outlined above may have different colours, such as a reflective colour or glow-in-the-dark plastic so that they are more easily found and also usable in the dark, for example in snow golf or night golf.

A person understanding this invention may now conceive of alternative structures and embodiments or variations of the above all of which are intended to fall within the scope of the invention as defined in the claims that follow.

The invention claimed is:

1. A golf tee comprising:

a neck for supporting a golf ball;

a reinforced skirt connected to the neck for providing elasticity to the golf tee, the reinforced skirt comprising:

a crown area; and, at least one skirt ring;

an open body connected to the reinforced skirt, the open body having a support rim for supporting the golf tee and an upper end for supporting the neck;

a plurality of support columns extending downwardly from the reinforced skirt; and, at least one support ring transversely connecting the plurality of support columns;

wherein the at least one skirt ring projects downwardly from the crown area and extends downwardly in between adjacent support columns of the plurality of support columns;

and wherein the crown area solidly extends from the neck to the at least one skirt ring.

2. The golf tee of claim 1, wherein each of the plurality of support columns extend downwardly from the reinforced skirt to the support rim;

wherein the at least one support ring transversely connects each support column of the plurality of support columns to at least another of the support columns within the open body, and wherein the open body defines a plurality of holes thereby reducing the weight of the golf tee, and the plurality of support columns and the at least one support ring increase the surface area of the golf tee thereby increasing drag on the golf tee.

3. The golf tee of claim 2 wherein the plurality of support columns curve along the open body, from a first position on the support rim to a second position on the reinforced skirt, the second position offset from the first position along a radius of the golf tee.

4. The golf tee of claim 2 wherein each one of the plurality of support columns is further comprised of a reinforced rib extending along the length of the plurality of support columns to increase the rigidity of the golf tee.

5. The golf tee of claim 1 wherein the support rim is further comprised of protrusions, the protrusions extending downwardly from the support rim to increase the friction and stability of the golf tee.

6. The golf tee of claim 2 wherein the plurality of support columns has a first width, the first width being greater than a second width of the support rim.

7. The golf tee of claim 2 wherein the at least one skirt ring interconnects the plurality of support columns to one another at an upper end of the plurality of support columns, wherein the crown area provides increased elasticity between the open body and the neck, and wherein the crown area and at least one skirt ring increase an elasticity and lifespan of the golf tee.

8. The golf tee of claim 7 wherein the crown area is generally disc-shaped.

9. A golf tee kit comprising:

at least two golf tees each having a different height, each one of the at least two golf tees comprising:

a neck for supporting a golf ball;

a reinforced skirt connected to the neck for providing elasticity to the at least two golf tees, the reinforced skirt comprising:

a crown area; and, at least one skirt ring;

an open body connected to the reinforced skirt, the open body having a support rim for supporting the at least two golf tees and an upper end for supporting the neck;

a plurality of support columns extending downwardly from the reinforced skirt; and, at least one support ring transversely connecting the plurality of support columns;

wherein the at least one skirt ring projects downwardly from the crown area and extends downwardly in between adjacent support columns of the plurality of support columns;

and wherein the crown area solidly extends from the neck to the at least one skirt ring.

10. The golf tee kit of claim 9, wherein each of the plurality of support columns extend downwardly from the reinforced skirt to the support rim;

wherein the at least one support ring transversely connects each support column of the plurality of support columns to at least another of the support columns within the open body, and wherein the open body defines a plurality of holes thereby reducing the weight of the at least two golf tees, and the plurality of support columns and the at least one support ring increase the surface area of the at least two golf tees thereby increasing drag on the at least two golf tees.

11. The golf tee kit of claim 10 wherein the plurality of support columns curve along the open body, from a first position on the support rim to a second position on the reinforced skirt, the second position offset from the first position along a radius of the at least two golf tees.

12. The golf tee kit of claim 10 wherein each one of the plurality of support columns is further comprised of a reinforced rib extending along the length of the plurality of support columns to increase the rigidity of the at least two golf tees.

13. The golf tee kit of claim 9 wherein the support rim is further comprised of protrusions, the protrusions extending downwardly from the support rim to increase the friction and stability of the at least two golf tees.

14. The golf tee kit of claim 10 wherein the plurality of support columns has a first width, the first width being greater than a second width of the support rim.

15. The golf tee kit of claim 10 wherein the at least one skirt ring interconnects the plurality of support columns to one another at an upper end of the plurality of support columns, wherein the crown area provides increased elasticity between the open body and the neck, and wherein the crown area and at least one skirt ring increase an elasticity and lifespan of the at least two golf tees.

16. The golf tee of claim 15 wherein the crown area is generally disc-shaped.

17. The golf tee kit of claim 9, wherein the at least two golf tees are stackable.

18. The golf tee kit of claim 9 further comprised of a rope connected to each one of the at least two golf tees to connect the at least two golf tees together.

19. The golf tee of claim 1, wherein the crown area, the plurality of support columns, and the at least one support ring define a plurality of holes, and wherein the at least one skirt ring extends downwardly into at least one of the plurality of holes.

20. The golf tee kit of claim 9, wherein the crown area, the plurality of support columns, and the at least one support ring define a plurality of holes, and wherein the at least one skirt ring extends downwardly into at least one of the plurality of holes.

* * * * *